United States Patent [19]

Guenther

[11] 4,343,052

[45] Aug. 10, 1982

[54] TOILET SUPPORT

[75] Inventor: Torbett B. Guenther, Plymouth, Mich.

[73] Assignee: C. D. Sparling Company, Plymouth, Mich.

[21] Appl. No.: 182,852

[22] Filed: Sep. 2, 1980

[51] Int. Cl.[3] ..... A47K 17/02

[52] U.S. Cl. ..... 4/254; 4/478; 297/414

[58] Field of Search ..... 4/254, 478, 523, 528, 4/530, 571, 576, 589, 597, 234, 237, 511, 546; 297/414–416, 418; D23/69–71

[56] References Cited

U.S. PATENT DOCUMENTS

| | | | |
|---|---|---|---|
| D. 179,394 | 12/1956 | Mills | 4/254 |
| 2,243,264 | 5/1941 | Stromblad | 4/254 |
| 2,698,440 | 1/1955 | Lyons | 4/254 |
| 2,774,975 | 12/1956 | Frank | 4/254 |
| 3,233,939 | 2/1966 | Chapman | 297/414 X |
| 3,405,411 | 10/1968 | Brown | 4/254 |
| 3,574,242 | 4/1971 | Trowbridge | 4/254 |
| 3,921,236 | 11/1975 | Klein | 4/254 |
| 3,969,778 | 7/1976 | Richards | 4/254 |
| 4,144,597 | 3/1979 | Guenther et al. | 4/254 |
| 4,196,480 | 4/1980 | Guenther et al. | 4/254 |

*Primary Examiner*—Stuart S. Levy

*Attorney, Agent, or Firm*—Barnes, Kisselle, Raisch & Choate

[57] ABSTRACT

A toilet support for use with a toilet bowl, comprising a pair of first arm portions, mounted on the toilet bowl for pivotal movement. A pair of second arm portions are mounted on said first arm portions and moveable generally axially of the first arm portions. The ends of the second arm portions are joined to one another by a connecting portion such that said first and second arm portions can be moved about the pivot and axially relative to one another such that in a first position the connecting portion of the second arm portions engages the edge of the toilet bowl and in another position the first and second arm portions are extended axially relative to one another such that the connecting portion can engage the floor adjacent the bowl and forwardly thereof. The first and second arm portions can be locked in any set axial position relative to one another.

16 Claims, 8 Drawing Figures

TOILET SUPPORT

This invention relates to toilet supports for assisting invalids and disabled persons in the use of a toilet bowl.

BACKGROUND AND SUMMARY OF THE INVENTION

In both institutions and homes wherein the aged or invalid persons reside, it has become more common for some form of support to be provided for assisting the persons in the use of the toilet facilities. Such toilet supports are shown, for example, in U.S. Pat. Nos. 2,774,975, 3,405,411, 3,574,242, 3,921,236 and 4,196,480.

Among the objects of the present invention are to provide a toilet support which will effectively support the invalid or disabled person in use; which can be utilized by such persons without assistance but is adaptable for use by persons with assistance; which is relatively simple and low in cost; which provides for ready access to the area around the toilet bowl for cleaning and maintenance; and which utilizes a minimum number of parts.

In accordance with the invention the toilet support for use with a toilet bowl comprises a pair of first arm portions, adapted to be pivotally mounted on the toilet bowl. A pair of second arm portions are mounted on said first arm portions and movable generally axially of the first arm portions. The ends of the second arm portions are joined to one another by a connecting portion such that said first and second arm portions can be moved about the pivot and axially relative to one another such that in a first position the connecting portion of the second arm portions engages the edge of the toilet bowl and in another position the first and second arm portions are extended axially relative to one another such that the connecting portion can engage the floor adjacent the bowl and forwardly thereof. Means are provided for locking the first and second arm portions in any set axial position relative to one another.

DESCRIPTION

Figure 1:
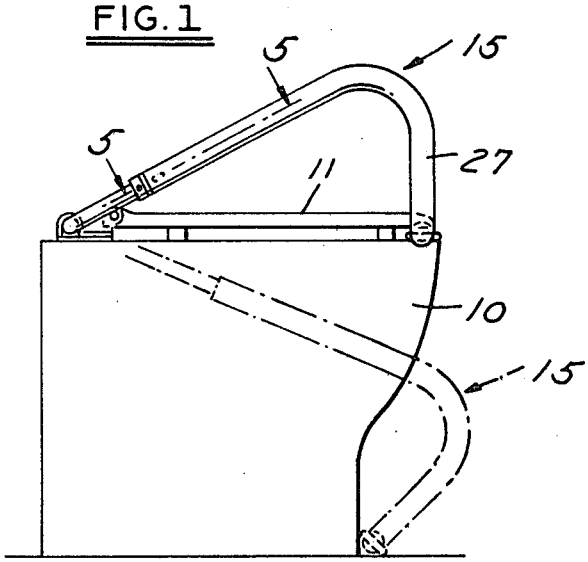
FIG. 1 is a side elevational view of the toilet support embodying the invention on a toilet bowl.
Figure 2:
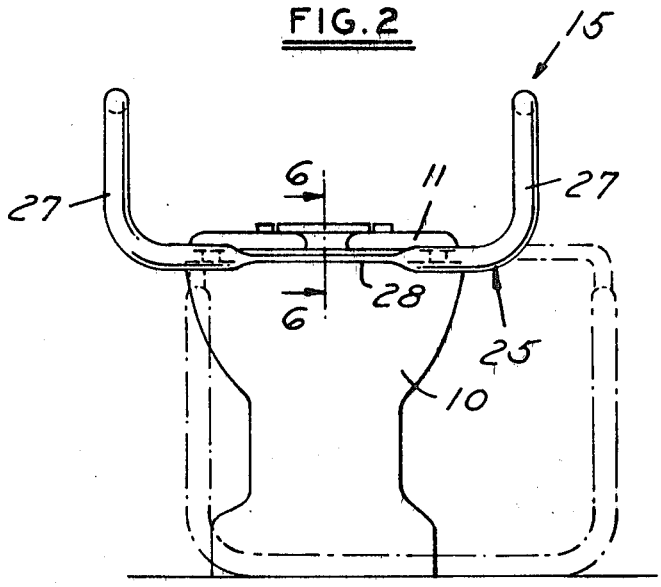
FIG. 2 is a front elevational view of the same.
Figure 3:
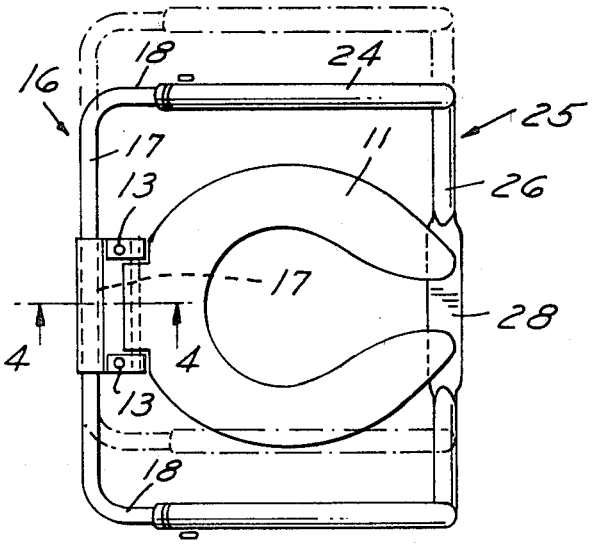
FIG. 3 is a top plan view of the same.
Figure 4:
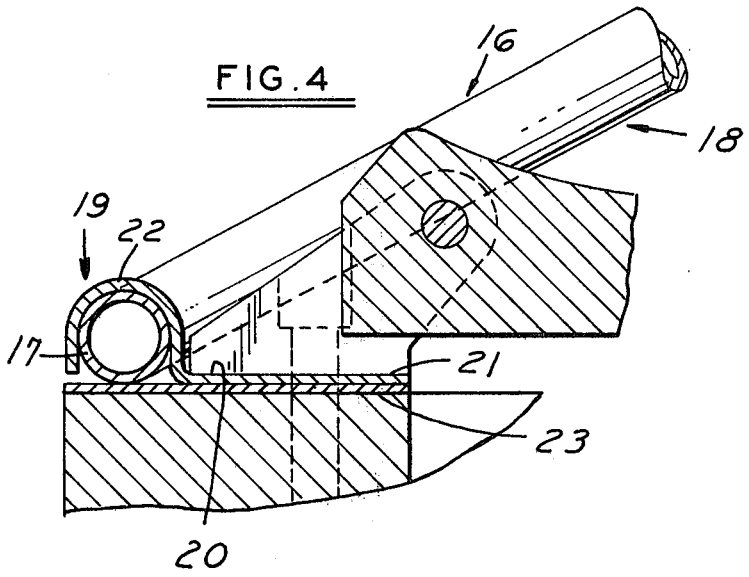
FIG. 4 is a fragmentary sectional view on an enlarged scale taken along the line 4—4 in FIG. 3.

Referring to FIGS. 1–3, the toilet support embodying the invention is adapted for use with a conventional toilet bowl 10 having a toilet seat 11 mounted on the rear edge thereof by well-known bearing hinge devices 13.

Figure 5:
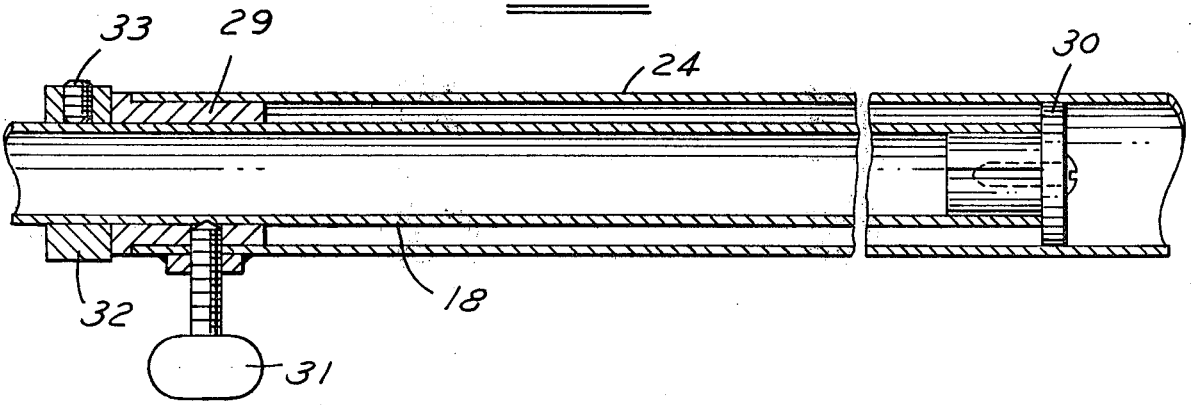
FIG. 5 is a fragmentary longitudinal sectional view on an enlarged scale taken along the line 5—5 in FIG. 1.
Figure 6:
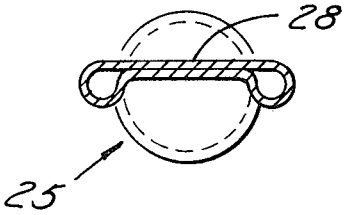
FIG. 6 is a sectional view taken along the line 6—6 in FIG. 2.

In accordance with the invention, the toilet support 15 comprises a first tubular member 16 including a transverse portion 17 and first arm portions 18. Transverse portion 17 is pivotally mounted on the rear of the toilet bowl by bearing means 19 comprising a plate 20 having a flat portion 21 clamped under the hinge members 13 that normally mount the toilet seat 11 and a curved portion 22 that engages the transverse portion 17. A plate 23 is preferably interposed between the bracket 19 and the toilet and at least the portion that engages the transverse portion 17 is provided with a plastic low friction coating. The ends of the arm portions 18 are telescoped within the arm portions 24 of a second part 25 that includes a transverse connecting portion 26 extending from the lower ends of the downwardly extending portion 27 of the arms 24. The intermediate portion of the connecting portion 26 is flattened as at 28 so that in one position of the toilet support the flattened portion 28 engages the forward edge of the toilet bowl as shown in FIGS. 1 and 2. As shown in FIG. 5, low friction plastic bearings 29 are provided at the ends of the arm portions 24 into which the arm portions 18 extend and a guide 30 is provided at the end of the arm portions 18. A thumb screw 31 is threaded through the arm portion 24 and bearing 29 into engagement with the arm portion 18 to lock the arms in position.

A collar 32 held in position by a set screw 33 serves as an adjustable stop to limit the inward position of the arm portions 24 relative to arm portions 18. This adjustment can be made to accommodate toilets having differing lengths from front to back.

When the toilet support is in the position shown in FIGS. 1 and 2, a person can use the arms to seat himself in a conventional manner. If a person requires assistance from someone else, the thumb screws 31 may be released and the toilet support adjusted by moving the arm portions 24 axially outwardly and swinging the section 25 downwardly to the broken line position touching the floor as shown in FIG. 1 until the invalid or disabled person is placed on the toilet seat, after which the toilet support is elevated and the arm portions 24 are moved axially inwardly to engage the flattened portion 28 which the toilet and the thumb screws locked.

Alternatively, if the person requires assistance to be given by displacement from a wheelchair, the toilet support can be moved axially along the hinge formed by the bracket 19 to one side of the toilet bowl as shown in broken lines in FIGS. 2 and 3 until the person is placed on the toilet seat after which the toilet support is moved back to the solid line position as viewed in FIGS. 2 and 3 and swung upwardly to engage the flattened portion with the toilet seat.

Figure 7:
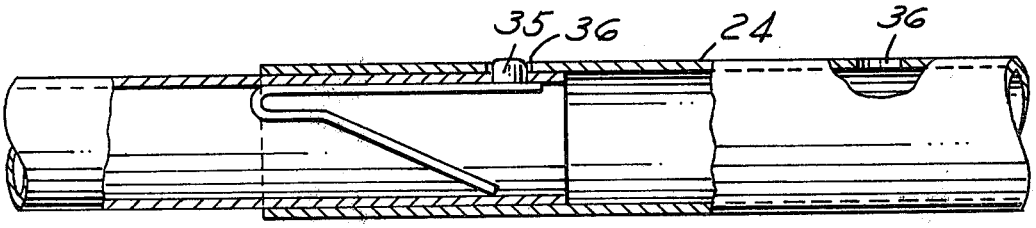
FIG. 7 is a fragmentary longitudinal sectional view of a modified form of toilet support.
Figure 8:
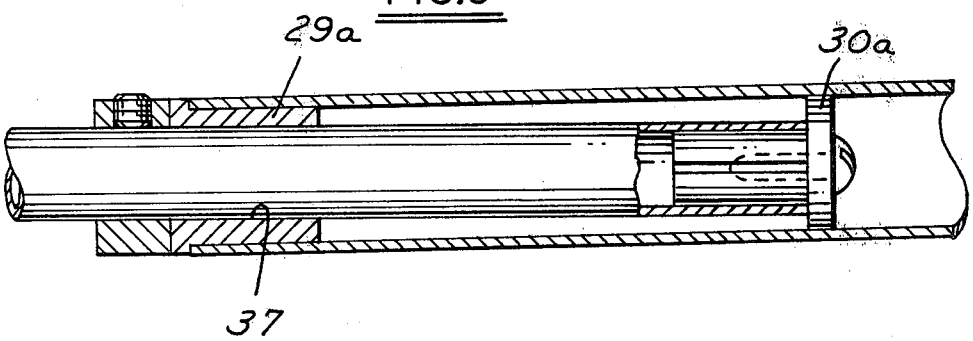
FIG. 8 is a fragmentary longitudinal sectional view of a further modified form of toilet support.

Alternative means of locking the arms in adjusted position are shown in FIGS. 7 and 8. As shown in FIG. 7, a spring-loaded detent 35 is adapted to engage one in a series of openings 36 in the arm portion 24. In the form shown in FIG. 8, the bearing 29*a* has an eccentric off-center opening 37 so that as one of the arms is telescoped outwardly relative to the other, the guide 30*a* cams or wedges locking the arms.

I claim:

1. In a toilet support for use with a toilet bowl, the combination comprising a pair of first arm portions, bearing means adapted to be mounted on said toilet bowl for mounting said arm portions on said toilet bowl, a pair of second arm portions mounted on said first arm portions and movable generally axially of said first arm portions, means joining the ends of said second arm portions such that said first and second arm portions can be moved about said bearing means and axially relative to one another such that in a first position the means connecting the second arm portions engage the edge of the toilet bowl and in another position the first and second arm portions are extended relative to one another such that the connecting portion can engage the floor adjacent the bowl and forwardly thereof.

2. The combination set forth in claim 1 including means for locking said first and second arm portions in any set axial position relative to one another.

3. The combination set forth in claim 2 wherein said manual locking means comprises a set screw.

4. The combination set forth in claim 2 wherein said locking means comprises eccentric bearing means into which one of said arm portions extends such that when one arm portion is extended relative to the other, a camming locking motion is achieved.

5. The combination set forth in claim 1 wherein said connecting portion includes a flattened for engaging the toilet bowl.

6. The combination set forth in claim 1 wherein said arms are movably laterally of toilet bowl so that an invalid may be placed on the toilet bowl from the side thereof.

7. The combination set forth in claim 1 wherein said second arm portions and cross portion constitute a single piece.

8. The combination set forth in claim 1 wherein said first arm portion and said second arm portions each comprise a single tube.

9. The combination set forth in any of claims 1 or 8 wherein said first and second arm portions are telescopically received within one another.

10. The combination set forth in claim 1 wherein said locking means comprises a spring-loaded detent in one of said members adapted to engage one of a series of recesses in the other of said members.

11. In a toilet support for use with a toilet bowl, the combination comprising a first tubular arm member including a transverse portion and a pair of first arm portions, bearing means adapted to be mounted on said toilet bowl for mounting said transverse portion on said toilet bowl, a second tubular member including a pair of second arm portions and a connecting portion joining the ends of said second arm portions, said first and second arm portions being telescoped relative to one another such that said first and second arm portions can be moved about said bearing means and relative to one another such that in a first position the connecting portion connecting the second arm portions engages the edge of the toilet bowl and in another position the first and second arm portions are extended axially relative to one another such that the connecting portion can engage the floor adjacent the bowl and forwardly thereof, and means for locking said first and second arm portions in any set axial position relative to one another.

12. The combination set forth in claim 11 wherein said connecting portion includes a flattened portion for engaging the toilet bowl.

13. The combination set forth in any of claims 11 or 12 wherein said first and second members are movably laterally of toilet bowl along the axis of said bearing means so that an invalid may be placed on the toilet bowl from the side thereof.

14. The combination set forth in claim 11 wherein said manual locking means comprises a set screw.

15. The combination set forth in claim 11 wherein said locking means comprises a spring-loaded detent in one of said members adapted to engage one of a series of recesses in the other of said members.

16. The combination set forth in claim 11 wherein said locking means comprises eccentric bearing means into which one of said arm portions extends such that when one arm portion is extended relative to the other, a camming locking motion is achieved.

* * * * *